US011292142B2

(12) United States Patent
Magrone et al.

(10) Patent No.: US 11,292,142 B2
(45) Date of Patent: Apr. 5, 2022

(54) SYSTEM AND METHOD FOR TREATING A PART OF A BODY

(71) Applicant: KONINKLIJKE PHILIPS N.V., Eindhoven (NL)

(72) Inventors: Fabio Gaetano Magrone, Eindhoven (NL); Luca Iaccarino, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 15/742,623

(22) PCT Filed: Jul. 7, 2016

(86) PCT No.: PCT/EP2016/066168
§ 371 (c)(1),
(2) Date: Jan. 8, 2018

(87) PCT Pub. No.: WO2017/005868
PCT Pub. Date: Jan. 12, 2017

(65) Prior Publication Data

US 2018/0194023 A1 Jul. 12, 2018

(30) Foreign Application Priority Data

Jul. 8, 2015 (EP) ..... 15175917

(51) Int. Cl.
*B26B 19/38* (2006.01)

(52) U.S. Cl.
CPC ..... *B26B 19/388* (2013.01); *B26B 19/382* (2013.01); *B26B 19/3846* (2013.01)

(58) Field of Classification Search
CPC ..... B26B 19/3818; B26B 19/388; B26B 19/3873; B26B 19/405; B26B 19/4056;
(Continued)

(56) References Cited

U.S. PATENT DOCUMENTS 3,413,985 A * 12/1968 Dlouhy ..... A45D 44/06 132/213
3,638,665 A * 2/1972 Staffas, Sr. ..... A45D 24/36 132/129
(Continued)

FOREIGN PATENT DOCUMENTS

CN 103802143 A 5/2014
GB 2462812 A * 2/2010 ..... B26B 19/00
(Continued)

*Primary Examiner* — Ghassem Alie
*Assistant Examiner* — Samuel A Davies

(57) ABSTRACT

A system for treating a part of a body to be treated, comprising a hand-held treating device, the treating device comprising a treating unit; wherein the treating device is configured such that a treating action of each portion of a plurality of portions of the treating unit can be selectively enabled and disabled independently of the treating action of the other portions of the treating unit; and a controller configured to receive information on a predetermined pattern to be created on the part of the body to be treated, and to selectively enable and disable the treating action of the portions of the treating unit according to the received information as the treating device is moved over the part of the body to create the predetermined pattern on the part of the body.

17 Claims, 6 Drawing Sheets

(58) Field of Classification Search
CPC ..... B26B 19/3813; B26B 21/405; B26B 21/4056; B26B 19/12; B26B 19/22; B26B 19/382; B26B 19/3826; B26B 19/3846; A45D 24/36; A45D 2026/008
See application file for complete search history.

(56) References Cited

U.S. PATENT DOCUMENTS 4,165,512 A * 8/1979 Peterson ..... G01D 15/14 219/216
4,602,542 A * 7/1986 Natrasevschi ..... B26B 19/00 132/214
4,918,909 A * 4/1990 Salkeld ..... A01D 45/007 56/10.2 R
4,972,584 A 11/1990 Baumann
5,970,304 A * 10/1999 Stemmle ..... G03G 15/231 399/364
6,149,124 A * 11/2000 Yang ..... F16K 31/408 251/30.03
6,973,931 B1 * 12/2005 King ..... A45D 19/02 132/212
7,479,137 B2 * 1/2009 Yamazaki ..... A45D 26/00 606/133
8,196,781 B2 * 6/2012 Greenwald ..... F16K 31/0651 222/207
2004/0250428 A1 * 12/2004 Melton ..... B26B 19/3813 30/200
2006/0253176 A1 * 11/2006 Caruso ..... A61B 18/203 607/88
2007/0204469 A1 * 9/2007 Caric ..... B26B 19/20 30/201
2007/0214653 A1 * 9/2007 Worgull ..... B26B 19/22 30/195
2008/0184565 A1 * 8/2008 Zoot ..... B26B 19/3813 30/196
2009/0188117 A1 * 7/2009 Putzer ..... B26B 19/3813 30/201
2013/0199346 A1 * 8/2013 Psimadas ..... B26B 21/225 83/13
2014/0102271 A1 4/2014 Krenik
2014/0137883 A1 * 5/2014 Rothschild ..... B26B 21/4056 132/200
2015/0164589 A1 * 6/2015 Moeskops ..... A61B 18/203 606/9

FOREIGN PATENT DOCUMENTS

WO 2004033164 A1 4/2004
WO 2013096572 A1 6/2013
WO 2013163999 A1 11/2013
WO 2015067484 A1 5/2015

* cited by examiner

SYSTEM AND METHOD FOR TREATING A PART OF A BODY

This application is the U.S. National Phase application under 35 U.S.C. § 371 of International Application No. PCT/EP2016/066168, filed on Jul. 7, 2016, which claims the benefit of International Application No. 15175917.2 filed on Jul. 8, 2015. These applications are hereby incorporated by reference herein.

FIELD OF THE INVENTION

The present invention relates to a system for treating a part of a body to be treated. In particular, the present invention relates to a system for cutting hair on a part of a body to be treated. The present invention also relates to a treating device configured to be used in a system as described above and a method for treating a part of a body to be treated.

BACKGROUND OF THE INVENTION

Devices for treating a part of a body, for example by cutting hair on a part of a body to be treated (such as a human or animal body), include powered hand-held devices that are placed against a part of a user's or subject's body and moved over areas where hair is to be cut, for example a trimmer. Such devices include mechanical hair cutting devices. The user of the device selects a cutting length by adjusting or selecting a guide, such as a comb or guard, which extends over a cutting blade and then selects which areas of hair to cut and which areas should not be cut by positioning and moving the device appropriately.

When cutting a user's own hair, or someone else's hair, significant skill is required to create a particular hairstyle or to provide a presentable result. In some cases a subject may desire to have a specific pattern cut into their hair (for example one or more letters, words or symbols, or even an image). Although it can be possible to use a trimmer to cut hair to create such a pattern, it requires great skill to do this with conventional devices.

SUMMARY OF THE INVENTION

It is an object of the invention to provide a system and/or method for treating a part of a body to be treated which substantially alleviates or overcomes the problems mentioned above.

According to a first aspect, there is provided a system for treating a part of a body to be treated, comprising a hand-held treating device, the treating device comprising a treating unit, wherein the treating device is configured such that a treating action of each portion of a plurality of portions of the treating unit can be selectively enabled and disabled independently of the treating action of the other portions of the treating unit; and a controller configured to receive information on a predetermined pattern to be created on the part of the body to be treated, and to selectively enable and disable the treating action of the portions of the treating unit according to the received information as the treating device is moved over the part of the body to create the predetermined pattern on the part of the body.

According to a second aspect, there is provided a method of treating a part of a body to be treated using a hand-held treating device, the treating device comprising a treating unit, wherein the treating device is configured such that a treating action of each portion of a plurality of portions of the treating unit can be selectively enabled and disabled independently of the treating action of the other portions of the treating unit, the method in a controller of the treating device comprising receiving information on a predetermined pattern to be created on the part of the body to be treated by the treating device; and selectively enabling and disabling the treating action of portions of the treating unit according to the received information as the treating device is moved over the part of the body to create the predetermined pattern on the part of the body.

According to a third aspect, there is provided a computer program product comprising a computer readable medium having computer readable code embodied therein, the computer readable code being configured such that, on execution by a controller of a hand-held treating device that comprises a treating unit and the treating device being configured such that a treating action of each portion of a plurality of portions of the treating unit can be selectively enabled and disabled independently of the treating action of the other portions of the treating unit, the controller is caused to perform the method described above.

Thus, the system and method described above provide for predetermined patterns to be created on a part of a body to be treated more easily than conventional systems and methods.

BRIEF DESCRIPTION OF THE DRAWINGS

Embodiments of the invention will now be described, by way of example only, with reference to the accompanying drawings, in which.

DETAILED DESCRIPTION OF THE EMBODIMENTS

As described above, it may be desirable to create a particular pattern (e.g. one or more letters, words or symbols or an image) on a part of a body to be treated. For example a subject may want a name or brand to be cut into their hair so that it is visible to others. Conventional trimmers cut hair using a cutting unit that cuts hair to a consistent length across the full width of the cutting unit as the cutting unit is moved across the head. This makes creating fine details in a haircut quite difficult and time consuming. The invention provides a system and method that allows a predetermined pattern to be created in hair more easily than conventional systems.

Figure 1:
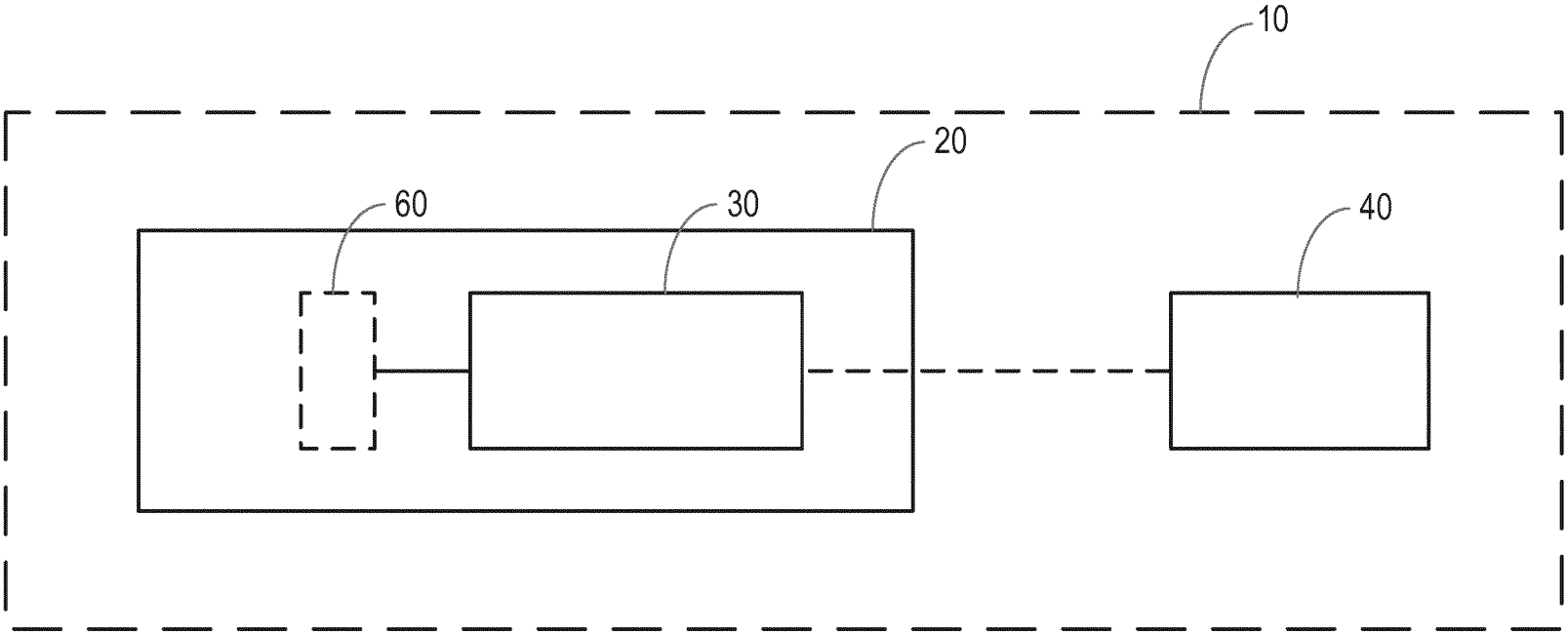
FIG. 1 is a block diagram of a system according to an embodiment.

FIG. 1 shows a system 10 for treating a part of a body to be treated according to a general embodiment of the invention. The system 10 comprises a hand-held treating device 20 that can be held by a user and used on a part of a body of a subject. The subject can be the person that is using and operating the device 20 (i.e. the user is using the device 20 on themselves) or the subject can be a different person to the user of the device 20. In the embodiments described below, it is assumed that the user of the system 10/treating unit 20 is the person being treated (i.e. the user is using the system 10 to treat themselves).

The treating device 20 includes a treating unit 30 that performs a treating action on the part of the body to be treated. In some embodiments the part of the body is hair (on the user's head, face, chest, legs, etc.), the treating unit 30 is a cutting unit and the treating action is cutting the hair.

The system 10 also includes a controller 40 that is configured control the operation of the treating device 20 and/or the treating unit 30 in accordance with the invention. In some embodiments the controller 40 is part of the treating device 20, but in other embodiments the controller 40 is separate from the treating device 20. In the embodiments where the controller 40 is separate from the treating device 20, the treating device 20 may comprise a respective controller or other circuitry that can be configured to receive control signals and/or other information from the controller 40 and to control the operation of the treating unit 30 in response to those signals and/or other information.

The controller 40 is configured to receive information relating to a predetermined pattern that is to be created on the part of the body during use of the treating device 20, and then to control the treating device 20 or treating unit 30 according to the received information as the treating device 20 is moved over the part of the body to be treated in order to create the predetermined pattern.

In particular, the invention provides that rather than merely being able to treat the part of the body across the full width of the treating unit 30 as in conventional treating devices, the treating device 20 according to the invention is configured such that the treating action of portions of the treating unit 30 can be selectively enabled and disabled as the treating device 20 is moved to provide a two-state (i.e. binary)/two-tone treating action (e.g. treating and not treating). The treating action of each portion can be controlled separately (i.e. independently) of the treating action of the other portions, thus the treating action of any portion can be enabled or disabled independently of whether the other (e.g. neighbouring) portions are enabled or disabled.

Controlling the two-state treating action of the portions of the treating unit 30 as the treating device 20 moves allows the predetermined pattern to be created on the part of the body. Thus the controller 40 dynamically controls the treating action of each portion based on a position of the treating device 20 on the part of the body and/or a speed of movement of the treating device 20, or based on the time since the start of the operation of the treating device 20.

Figure 2:
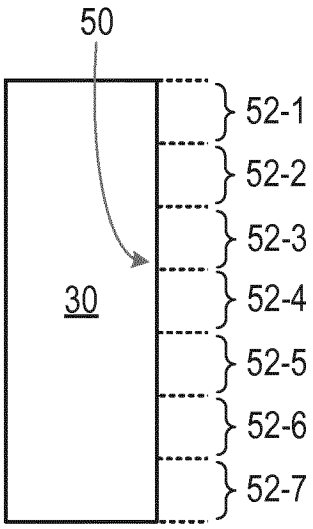
FIG. 2 illustrates a treating unit divided into a plurality of portions.

FIG. 2 illustrates an exemplary treating unit 30 that provides a treating action across a treating face 50. In the case of a cutting unit 30, the treating face 50 corresponds to the cutting elements (e.g. teeth or blades). The treating face 50 is divided into a plurality of portions 52, the treating action of each of which can be selectively enabled and disabled by the controller 40. Each portion 52 directly neighbours another portion 52. In this illustration, the treating unit 30 is considered as having seven portions 52 (labelled 52-1 to 52-7 respectively), but it will be appreciated that treating units 30 can have more or less portions 52 (e.g. two or more). In some embodiments the number of portions 52 can be between 20 and 100. It will be appreciated from the teachings below that a larger number of portions for a given treating unit 30 increases the resolution of the patterns that can be created by the treating device 20. The portions 52 are typically the same size as each other, but this does not have to be the case.

In some embodiments the treating device 20 comprises a mechanism 60 that can be controlled by the controller 40 to selectively enable and disable the treating action of each portion 52 of the treating unit 30. For example, in the preferred embodiment in which the system is for cutting hair, the mechanism 60 can comprise a plurality of deflector elements that can each be individually actuated in order to deflect hair away from a portion 52 of the cutting unit 30 and prevent that deflected hair from being cut. Put another way, actuating the deflector element disables the cutting action of that portion 52 by preventing hair from coming into contact with that portion 52 of the cutting unit 30. An exemplary mechanism 60 in accordance with this embodiment is described in more detail below with reference to FIG. 8.

In other embodiments, portions 52 of the treating unit 30 can be individually activated and deactivated in order to enable and disable the treating action of each portion 52 of the treating unit 30. For example, in the preferred embodiment in which the system is for cutting hair, the cutting unit 30 may comprise a plurality of cutting elements (e.g. a plurality of pairs of cutting blades) aligned next each other to form the treating face 50, and individual cutting elements can be selectively activated and deactivated (i.e. switched on or off) to cut hair as required in order to create the predetermined pattern. It will be appreciated that in this example a separate mechanism 60 for selectively enabling and disabling the treating action of each portion 52 may not be required. In another example where the system is for cutting hair, a mechanism 60 may be provided that can selectively engage and disengage part of the cutting unit 30, e.g. by moving part of a cutting blade or by moving a tooth or teeth on a cutting blade away from another blade so that hair is not cut in that portion 52.

Figure 3:
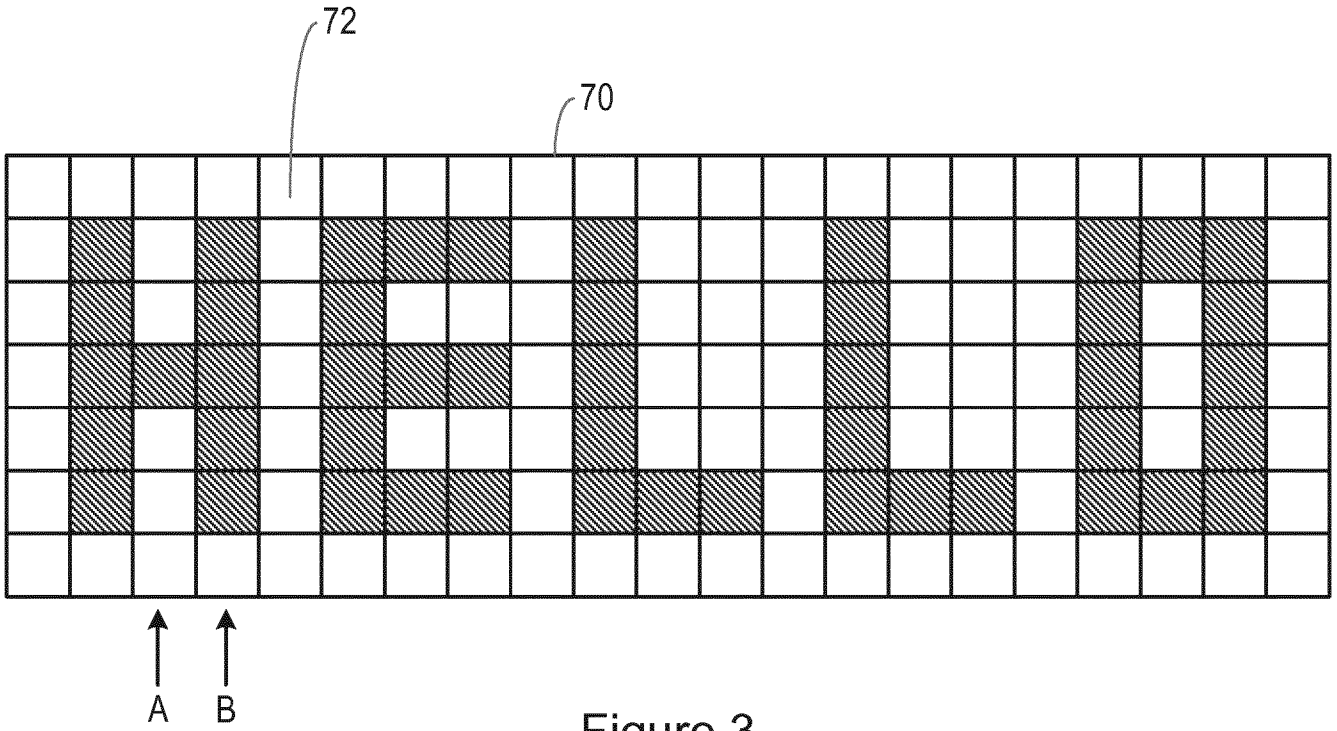
FIG. 3 shows an exemplary predetermined pattern.

FIG. 3 illustrates an exemplary pattern 70 that can be created on a part of the body in accordance with the invention. In this example the pattern is the word 'HELLO' and is shown in FIG. 3 in a pixelated format, with each pixel 72 corresponding to a single portion 52 at a particular position on the body or at a particular time during operation of the treating device 20. Thus, based on the exemplary treating unit 30 shown in FIG. 2, the pattern 70 comprises seven rows of pixels 72. Each pixel can take one of two values (e.g. 0 and 1 or on and off) that represent whether the treating action of the respective portion 52 should be enabled or disabled to create that pixel.

In FIG. 3 the cross-hatched pixels indicate that the treating action of the respective portion 52 should be enabled and the white pixels indicate that the treating action of the respective portion 52 should be disabled.

Thus, each column of the pattern 70 indicates the required treating action of each of the portions 52 (i.e. enabled or disabled) for that part of the pattern. Thus the series of columns in the pattern 70 indicate the treating action for each portion at each of a series of positions. An alternative way to view the information in the pattern 70 is that it represents the required enabling and disabling of the treating action as the treating device is moved over the part of the body.

The pattern 70 can be provided to the controller 40 in the form of an electronic computer file having a format similar to that shown in FIG. 3 (e.g. a format that is suitable for the controller 40 to use directly to selectively enable and disable the treating action of the portions 52 of the treating unit 30 to create the pattern 70), or it can be provided in the form of a computer file having a different format (e.g. a higher resolution image file), in which case the controller 40 can be configured to process the computer file into a suitable form to enable the controller 40 to selectively enable and disable the treating action of the portions 52 of the treating unit 30 to create the pattern 70. In some embodiments, the controller 40 can obtain information on the pattern 70 from an image taken by a camera in the system 10. For example, in some embodiments the system 10 can comprise another device that is separate from the treating device 20, where the separate device can be, for example, a mobile phone, a tablet computer or a laptop computer, and a camera in the separate device can be used to obtain an image (e.g. photograph) that includes a pattern that a user of the system 10 wishes to create using the system 10. The controller 40 can then be configured to process the image to obtain or determine the information on the pattern 70 that is required to control the operation of the treating device 20 so that the pattern 70 can be created on the part of the body.

In order for the controller 40 to appropriately control the enabling and disabling of the treating action of the portions 52 to create the predetermined pattern 70, the controller 40 can be configured to determine when to enable/disable each portion 52 based on the information on the pattern 70 in order to create the pattern 70 on the part of the body.

In an embodiment, the controller 40 can simply adjust the treating action of the portions 52 based on the time elapsed since the start of the use of the treating device 20. In this embodiment the controller 40 can calculate the timing of the adjustment of the treating action of each portion 52 based on a notional speed of movement across the part of the body (e.g. based on a typical speed of movement for such a treating device 20). Provided the user moves the treating device 20 across the part of the body at a constant speed close to the notional speed, the pattern 70 can be formed reasonably accurately. However, if the user moves the treating device 20 too slowly, too quickly or varies the speed during the treatment, the pattern created on the part of the body will appear distorted compared to the predetermined pattern 70.

Thus, in some, more preferred, embodiments the system 10 can further comprise a position identifier that is configured to generate information on the position of the treating device 20 relative to the part of the body. The controller 40 can use this position information to determine where the treating 20 is on the part of the body and determine, using the information on the pattern 70, which portions 52 of the treating unit 30 should have their treating action enabled and disabled at that position in order to create the relevant part of the predetermined pattern 70 on that part of the body.

For example if the position identifier indicates that the treating device 20 is at a position on the body corresponding to position 'A' in FIG. 3 (or at a position in the creation of the pattern 70 corresponding to A in FIG. 3 i.e. a distance of two pixels to the right of the position where pattern 70 was started), the controller 40 will enable the treating action of portion 52-4, and the controller 40 will disable the treating action of the other portions 52-1 to 52-3 and 52-5 to 52-7. If the information from the position identifier indicates that the treating device 20 is now at position 'B' (corresponding to the column of pixels adjacent to the column of pixels at position A), then the controller 40 will adjust the treating action of the treating unit 30 by enabling the treating action of portions 52-2 to 52-6 and disabling the treating action of portions 52-1 and 52-7.

In alternative embodiments, instead of determining an absolute position of the treating device 20 on the part of the body, the system 10 may adjust the treating action of the portions 52 of the treating unit 30 based on the speed at which the treating device 20 is moving across the part of the body. Thus, the system 10 can further comprise a speed identifier that is configured to generate information on the speed at which the treating device 20 is moving relative to the part of the body. The controller 40 can use the information on the pattern 70 and the speed information along with information on the current time or elapsed time since the start of the operation of the treating device 20 to determine the timing of the enabling and disabling of each of the portions 52 of the treating unit 30. For example, if the pattern 70 is to be, say, 0.1 metres long when it is created on the part of the body, and the speed identifier indicates that the treating device 20 is moving at a speed of 0.01 metres/second across the part of the body, then the controller 40 will adjust the treating action of the portions 52 according to the next column of pixels in pattern 70 every 10/21 seconds (since at that speed the pattern is created over a period of 10 seconds and there are 21 pixels in each row of the pattern 70). Thus, for example between 20/21 seconds and 30/21 seconds after the start of the operation of the treating device 20 (which corresponds to position A in FIG. 3), the controller 40 will enable the treating action of portion 52-4 and disable the treating action of the other portions 52-1 to 52-3 and 52-5 to 52-7. It will be appreciated that if the speed identifier detects a change in the speed of movement, the controller 40 can recalculate the timing of the adjustment of the treating action of the portions 52 accordingly.

It will be appreciated that in some embodiments, the system 10 can use information on both position and speed of movement to improve the accuracy of the timing of the adjustment to the treating action of the portions 52 of the treating unit 30.

In some embodiments, the position identifier and/or speed identifier can be an imaging module, such as a camera, that is configured to obtain an image or images of the part of the body and/or the treating device 20. The images can be processed to determine the position of the treating device 20 relative to the part of the body, and, in the case of a speed identifier, a series of images can processed to determine a speed of movement of the treating device 20. Those skilled in the art will be aware of suitable techniques for processing images to identify objects such as treating devices 20 and/or parts of a body, and such techniques are not described in any detail herein.

In alternative embodiments, the position identifier and/or speed identifier can be an electromagnetic field (EMF) detector that is configured to detect changes in an electromagnetic field and to generate information indicative of the position of the treating device 20 relative to the part of the body to be treated based on a detected electromagnetic field. In this embodiment, the position identifier and/or speed identifier may include one or more sources of electromagnetic fields that are placed on the part of the body to enable the EMF detector to triangulate the position of the treating device 30. An example of a system that uses electromagnetic field detection that can be used in the system 10 according to the invention is shown in WO 2013/163999.

Other types of position identifier and/or speed identifier that could be used in the system, 10 include those based on microwave detection, laser detection, inertial measurements, ultrasound and/or ultrasonic detection. An example of a system that uses ultrasound to identify the position of a device is shown in WO 2013/096572. A simple embodiment of a position and/or speed identifier comprises a mechanical wheel that contacts the part of the body and rotates as the treating device 20 is moved, and an encoder that tracks or records the rotation of the wheel. The amount of rotation of the wheel can be converted to a measurement of the distance traversed and/or the speed of movement.

In some embodiments the position identifier/speed identifier can be part of the treating device 20, but in other embodiments the position identifier/speed identifier can be separate from the treating device 20.

Figure 4:
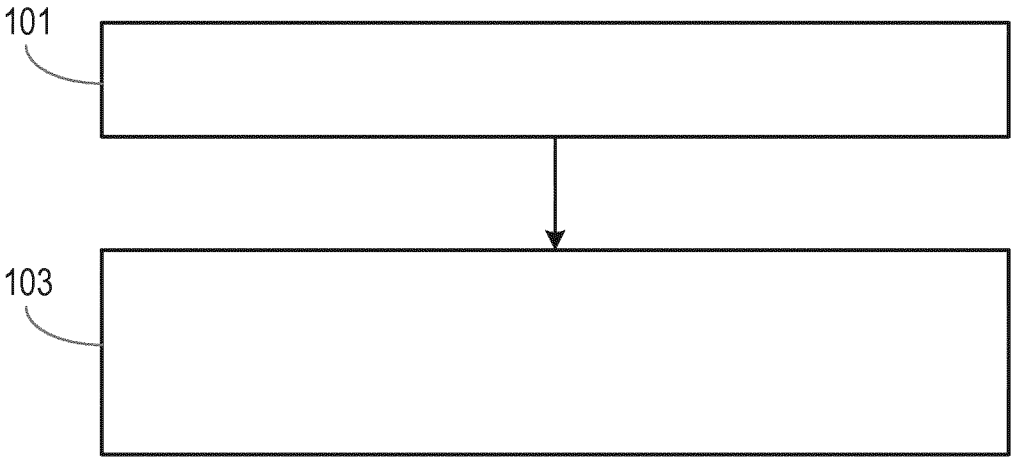
FIG. 4 is a flow chart illustrating a method of operating a system according to an embodiment.

FIG. 4 is a flow chart illustrating a method of treating a part of a body to be treated using hand-held treating device 20. In the described embodiment the method is performed in controller 40, but it will be appreciated that in other embodiments, the method can be performed in another part of the system 10. In step 101, the controller 40 receives information on a predetermined pattern 70 to be created on the part of the body to be treated by the treating device 20. Then, in step 103, the controller 40 selectively enables and disables the treating action of portions 52 of the treating unit 30 according to the received information as the treating device 20 is moved over the part of the body in order to create the predetermined pattern 70 on the part of the body.

Although the following embodiments of the invention described with reference to FIGS. 5-8 relate specifically to cutting hair, it will be appreciated by those skilled in the art that the teaching of these embodiments can be readily applied to systems for performing other types of treatment on a part of the body.

Figure 5:
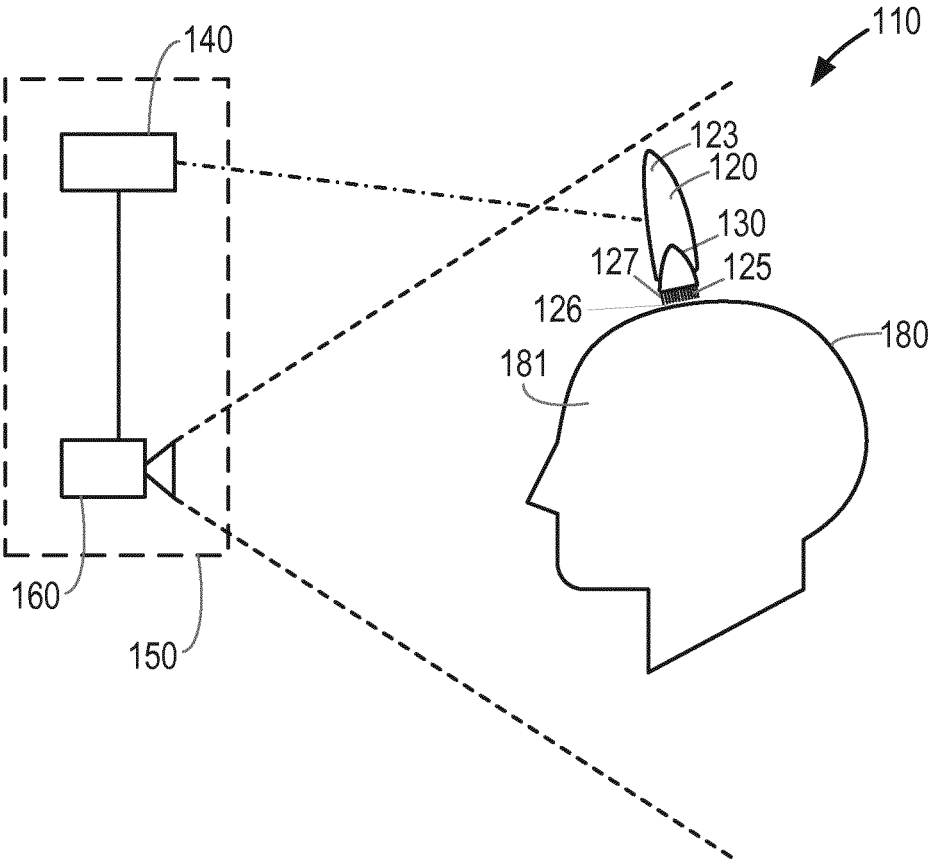
FIG. 5 is a block diagram a system for cutting hair according to an embodiment.

FIG. 5 illustrates a system 110 for cutting hair. The system 110 comprises a hand held cutting device 120 having a cutting unit 130, and a controller 140. The controller 140 controls the operation of the cutting device 120 and/or system 110. In this embodiment the controller 140 is part of a base unit 150, but in other embodiments the controller 140 can be in the cutting device 120 itself. In this illustrated embodiment a camera 160 is provided as part of a position identifier and/or speed identifier for providing information indicative of the position/speed of the cutting device 120 relative to the part of the body. The camera 160 is part of the base unit 150, but in other embodiments it can be part of the cutting device 120.

The cutting device 120 can be a hand-held electrical hair trimming device, but it will be apparent that the cutting device 120 may have an alternative arrangement. For example, the cutting device 120 may be a hand-held electrical shaving device. In use, the cutting device 120 is moved over the skin 180 of a part of a user's body, for example their head 181, to trim hair on that part of the body.

The controller 140, camera 160 and cutting device 120 communicate with each other. In the present embodiment the controller 140 and the cutting device 120 communicate via a wireless connection, but alternative arrangements are envisaged. For example, the controller 140 and cutting device 120 may be connected by a wired connection. Wireless modules (not shown in FIG. 2), for example radio or infra-red transmitters and receivers, act to wirelessly connect the different components of the system 110. Suitable wireless technologies include Bluetooth, Zigbee, Wi-Fi, etc. Controller 140 may also be able to connect wirelessly to other devices or components external to system 110.

The base unit 150 in the present embodiment is a dedicated part of the system 110. However, it will be understood that the base unit 150 may be a device having a controller and camera, amongst other components. For example, the base unit 150 may be or comprise a mobile phone, tablet computer or laptop computer. In these examples, the base unit 150 can store and execute a suitable application for implementing the method shown in FIG. 4.

As noted above, the information on the pattern 70 to be created can be obtained from an image obtained by a camera in the system (e.g. camera 160 or another camera not shown in FIG. 5). The controller 140 can be configured to process that image to extract the information required to control the cutting action of the cutting unit 130 to create the pattern 70 on the part of the body. In some embodiments, the image processing can be performed by the controller 140 under the control of the user of the system 110, with the user being able to select part of an image that is to form the pattern 70 (e.g. by cropping and/or rotating the image) and/or being able to perform other typical image processing functions.

Figure 6:
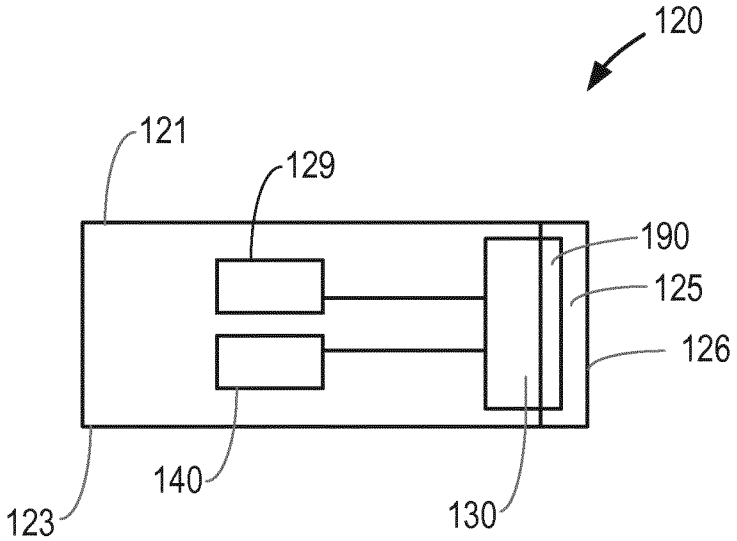
FIG. 6 is a block diagram of a cutting device according to an embodiment.

Referring to FIG. 6, the cutting device 120 comprises a main body 121 with a cutting unit 130 at one end of the main body 121. The main body 121 defines a handle portion 123. The body 121 and the cutting unit 130 are arranged so that the handle portion 123 is able to be held by a user.

The cutting unit 30 is configured to trim or cut hair and may comprise any suitable mechanism for cutting hair.

Figure 7:
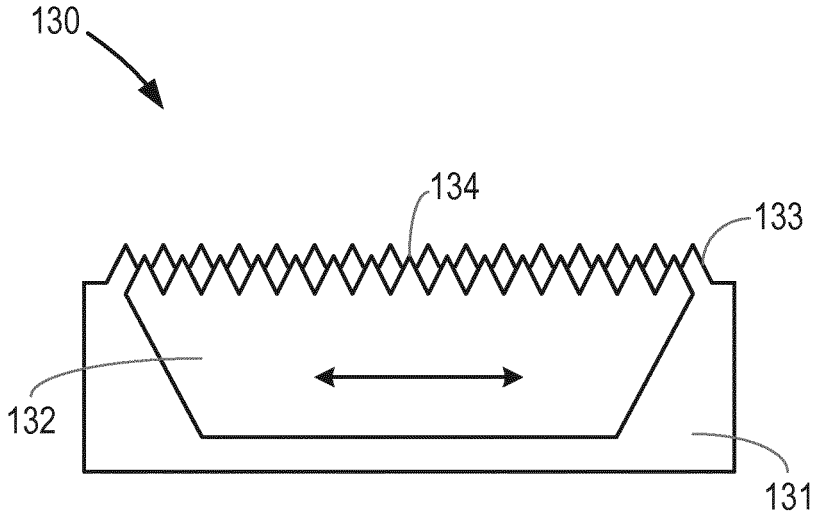
FIG. 7 is a schematic diagram of a cutting unit according to an embodiment.

One form of cutting mechanism is shown in FIG. 7. In this mechanism, the cutting unit 130 has a stationary treating element 131, and a moveable treating element 132 which moves relative to the stationary treating element 131 (as indicated by the arrow). Hairs protrude past the stationary treating element 131, and are cut by the moveable treating element 132. In particular, in one embodiment the stationary treating element 131 comprises a stationary blade 131, and the moveable treating element 132 comprises a moveable blade 132. The stationary blade 131 has a stationary edge comprising a first array of teeth 133. The moveable blade 132 has a moveable edge comprising a second array of teeth 134. The stationary edge and moveable edge are aligned parallel to each other. The moveable blade 132 is moveable in a reciprocal manner against the stationary blade 131 in a hair shearing engagement. Therefore, the second array of teeth 134 is arranged to move in a reciprocal motion relative to the first array of teeth 132. In the present embodiment, the stationary treating element 131 and the moveable treating element 132 form cooperating mechanical cutting parts.

The cutting unit 130 is driven by a driver 129. The driver 129 acts to drive the cutting unit 130 (e.g. the moveable blade 132 in particular) in a driving action. In the present embodiment, the driver 129 can be an electric motor. The driver 129 drives the moveable element relative to the stationary element in a reciprocal motion. The driver 129 is controlled by the controller 140.

Alternative cutting mechanisms are also envisaged. For example the cutting unit 130 can comprise a foil through which hairs protrude, and a moving blade moves over the foil to cut the protruding hairs.

Referring again to FIGS. 5 and 6, the device 120 has a guide 125 that has a guide face 126. The guide face 126 forms an end surface. The guide face 126 is configured to be disposed against the part of the body on which hair is to be cut. The guide face 126 is spaced from the cutting unit 130. However, in one embodiment the cutting unit 130 and/or the guide 125 may be adjustable so that the guide face 126 and the cutting unit 130 lie planar with each other. The guide face 126 is arranged to space the cutting unit 130 from the part of the body on which hair is to be cut, for example the skin 180 of a user's head 181, in order to control the length of the hair that is left after cutting. In another embodiment the guide 125 may be omitted. The guide 125 is also referred to herein as a guard.

In the present embodiment, the guide 125 is a comb. The guide 125 has a plurality of parallel, but spaced, comb teeth 127. The spaced comb teeth 127 allow the passage of hair therebetween so that the hair is exposed to the cutting unit 130 and cut by the cutting unit 130. A distal surface of each tooth from the main body 121 forms the guide face 126. The guide 125 can be mounted to the main body 121 or to the cutting unit 130. The guide 125 can be removably mounted to the main body 121. When the guide 125 is removed the cutting unit 130 can be cleaned. The guide 125 can be interchangeable with another guide and/or replaced in order to adjust the length of hair that is left after cutting.

As shown in FIG. 6, the cutting device 120 also comprises a mechanism 190 that can be controlled by the controller 140 to selectively enable and disable the cutting action of each of a number of portions of the cutting unit 130 during use of the device 120 to create the pattern 70. A top view and front view of an exemplary mechanism 190 is shown in FIGS. 8(*a*) and 8(*b*) respectively.

This exemplary mechanism 190 comprises a plurality of deflector elements 191 that can each be individually actuated in order to deflect hair away from a portion of the cutting unit 130 and prevent that deflected hair from being cut. In this embodiment, each portion of the cutting unit 130 corresponds to the part of the cutting unit 130 between each neighbouring pair of teeth 127 in the comb 125, and the mechanism 190 comprises a deflector element 191 for each portion. When actuated by the controller 140, a deflector element 191 is moved from a retracted position in which the deflector element 191 does not affect the cutting action of that portion of the cutting unit 130 (i.e. the deflector element 191 does not deflect hair away from that portion of the cutting unit 130) to an engaged position between the comb teeth 127 in which the deflector element 191 deflects hair away from the portion of the cutting blades 131, 132 behind the deflector element 191 (when viewed from the front of the cutting device 120). In particular, the deflector element 191 acts to push or bend hair over as the cutting device 120 is moved across the part of the body so that the hair passes below the cutting blades 131, 132 and is not cut.

Figure 8A:
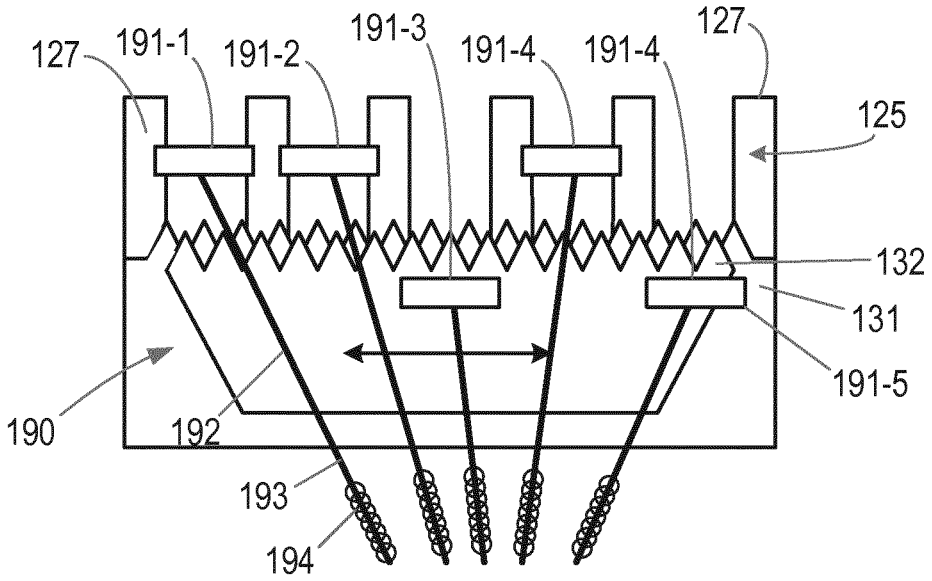
FIG. 8 shows schematic diagrams of a deflecting mechanism according to an embodiment.
Figure 8B:
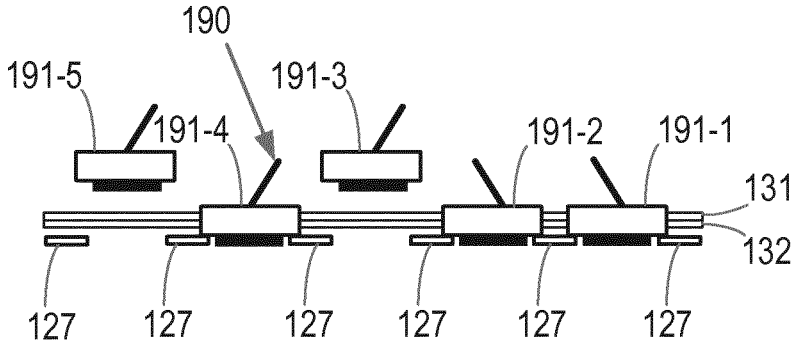

In the embodiment of FIG. 8, the comb 125 comprises six teeth 127, and thus the mechanism 190 comprises five deflector elements 191. Deflector elements 191-1, 191-2 and 191-4 are shown in the engaged or actuated position in which they act to deflect hair below the cutting unit 130 so that the hair is not cut (i.e. the cutting action of that portion of the cutting unit 130 is disabled), and deflector elements 191-3 and 191-5 are shown in the disengaged or retracted position in which hair is allowed to be cut by the respective portion of the cutting unit 130. Although this exemplary mechanism 190 is shown in FIG. 8 as being used with a comb 125, it will be appreciated that the mechanism 190 can also be used when no comb 125 is attached to the cutting device 120.

As appreciated by those skilled in the art, the deflector elements 191 can be actuated and retracted using any of a number of different types of actuator. In the illustrated example, each deflector element 191 is moved between the actuated and retracted positions using an electromagnetic actuator. Thus, each deflector element 191 is connected to an arm 192 having a magnetic portion 193 and a coil 194 that surrounds the magnetic portion 193. Each coil 194 is connected to suitable control circuitry (e.g. controller 140 or other circuitry in the cutting device 120) that controls the magnitude and direction of the current supplied to the coil 194. By supplying a suitable current to the coil 194, the magnetic portion 193 and thus the arm 192 and deflector element 191 can be moved to engage or disengage the deflector element 191 as required. The current supplied to each of the individual coils 194 is controlled during use of the cutting device 120 in accordance with the information on the pattern 70 in order to create the pattern 70 on the part of the body. Such an arrangement allows the cutting action of the cutting unit 130 to be adjusted quickly during use of the cutting device 120, for example the cutting action can be changed at a rate of 5-10 Hz.

Those skilled in the art will appreciate that many different types of mechanical system can be used to transfer the movement caused by the electromagnetic actuation to the deflector element 191 so as to engage and disengage the deflector element 191. For example the mechanical system can comprise any suitable arrangement of arms, levers, springs, pistons and/or pulleys.

Other suitable types of actuator include electrostatic actuators, actuators that comprise piezoelectric materials, or hydraulic or pneumatic actuators (e.g. pistons).

It will be appreciated that the components and features of the system 110 shown in FIGS. 5, 6, 7 and 8 are not exhaustive, and actual implementations of system 110 will include further components and features to those shown and described above. For example the cutting device 120 may include a power supply, such as a battery, or means for connecting the cutting device 120 to a power supply, and one or more buttons, controls, or other user interface elements to allow a user to control the operation of the system 110.

Thus, there is provided a system and/or method for treating a part of a body to be treated which allows a specific pattern to be created on the part of the body.

Variations to the disclosed embodiments can be understood and effected by those skilled in the art in practicing the claimed invention, from a study of the drawings, the disclosure and the appended claims. In the claims, the word "comprising" does not exclude other elements or steps, and the indefinite article "a" or "an" does not exclude a plurality. A single processor or other unit may fulfil the functions of several items recited in the claims. The mere fact that certain measures are recited in mutually different dependent claims does not indicate that a combination of these measures cannot be used to advantage. A computer program may be stored/distributed on a suitable medium, such as an optical storage medium or a solid-state medium supplied together with or as part of other hardware, but may also be distributed in other forms, such as via the Internet or other wired or wireless telecommunication systems.

Any reference signs in the claims should not be construed as limiting the scope.

The invention claimed is:

1. A system for treating a part of a body to be treated, the system comprising:

a hand-held treating device, the treating device having a cutter configured to cut hair of the body, the cutter having a treatment face divided into a plurality of portions that extend across the cutter and that can each perform a treating action of cutting hair of the body, wherein the treating device is configured such that each portion of the plurality of portions of the cutter can be selectively enabled and disabled independently of other portions of the plurality of portions of the cutter, wherein the treating device comprises a mechanism having a plurality of deflector elements, each one of the plurality of deflector elements corresponding to one of the plurality of portions of the cutter, and wherein each deflector element can be selectively activated in order to disable the respective portion of the plurality of portions of the cutter and deactivated in order to enable the respective portion of the plurality of portions of the cutter; and a controller configured to receive information on a predetermined pattern to be created on the part of the body to be treated, wherein the controller is configured to selectively enable or disable the treating action of each of the plurality of portions of the cutter according to the received information as the treating device is moved over the part of the body to create the predetermined pattern on the part of the body, wherein a given position of the plurality of portions of the cutter is maintained relative to the treating device when a deflector element of the plurality of deflector elements is activated and deactivated, and wherein when a respective deflector element is activated, the respective deflector element extends out in front of the corresponding one of the plurality of portions of the cutter and crosses a cutting plane of the cutter.

2. The system as claimed in claim 1, wherein the information on the predetermined pattern comprises information indicative of whether the treating action of each portion of the plurality of portions of the cutter is to be enabled or disabled at each of a series of positions of the treating device on the part of the body.

3. The system as claimed in claim 1, wherein the information on the predetermined pattern comprises a sequence of actions for each portion of the plurality of portions of the cutter that represents the required enabling and disabling of the treating action as the treating device is moved over the part of the body.

4. The system as claimed in claim 1, wherein each deflector element of the plurality of deflector elements is directly connected to a corresponding armature for selectively enabling or disabling the treating action.

5. The system as claimed in claim 1, wherein each deflector element of the plurality of deflector elements is configured to prevent hair being cut by a respective portion of the cutter when a deflector element of the plurality of deflector elements is activated by deflecting hair away from the respective portion of the cutter.

6. The system as claimed in claim 1, wherein the system further comprises:

a position identifier configured to generate information indicative of the position of the treating device relative to the part of the body to be treated; and wherein the controller is configured to use the information indicative of the position of the treating device and the information on the predetermined pattern to determine which of the plurality of portions of the vutter should have their treating action enabled and which of the plurality of portions of the cutter should have their treating action disabled at each position of the treating device on the part of the body in order to create the predetermined pattern.

7. The system as claimed in claim 6, wherein the position identifier is configured to generate information indicative of the position of the treating device relative to the part of the body to be treated comprises:

an imaging module configured to generate information indicative of the position of the treating device relative to the part of the body to be treated based on an image of a part of the body and the treating device; and/or an electromagnetic field detector configured to detect changes in an electromagnetic field and to generate information indicative of the position of the treating device relative to the part of the body to be treated based on the detected changes in the electromagnetic field.

8. The system as claimed in claim 1, wherein the system further comprises:

a speed identifier configured to generate information indicative of the speed at which the treating device is moving relative to the part of the body to be treated; and wherein the controller is configured to use the information indicative of the speed of the treating device and the information on the predetermined pattern to determine the timing of the enabling and disabling of the treating action of the plurality of portions of the cutter as the treating device is moved over the part of the body in order to create the predetermined pattern.

9. The system as claimed in claim 8, wherein the speed identifier configured to generate information indicative of the speed at which the treating device is moving relative to the part of the body to be treated comprises:

an imaging module configured to generate information indicative of the speed at which the treating device is moving relative to the part of the body to be treated based on images of a part of the body and the treating device; and/or an electromagnetic field detector configured detect changes in an electromagnetic field and to generate information indicative of the speed at which the treating device is moving relative to the part of the body to be treated based on the detected changes in the electromagnetic field.

10. The system as claimed in claim 1, wherein the system is a system for cutting hair on the part of the body, wherein the treatment face is configured to be placed in contact with the part of the body to be treated.

11. The system as claimed in claim 10, wherein the cutter comprises a first blade having a first cutting edge and a second blade having a second cutting edge, wherein the first cutting edge is arranged parallel to the second cutting edge and wherein at least one of the first blade and the second blade is moveable in a reciprocal manner with respect to each other in a hair shearing arrangement.

12. The system as claimed in claim 1, wherein each deflector element of the plurality of deflector elements is directly connected to a corresponding arm having a magnetic portion and a coil that surrounds the magnetic portion for correspondingly activating or deactivating each deflector element of the plurality of deflector elements.

13. The system as claimed in claim 12, wherein each of the coils are connected to the controller that controls a magnitude and direction of current supplied to each of the coils.

14. A method of treating a part of a body to be treated using a hand-held treating device, the treating device having a cutter configured to cut hair of the body, the cutter having a treatment face divided into a plurality of portions that extend across the cutter and that can each perform a treating action of cutting hair of the body, wherein the treating device is configured such that each portion of the plurality of portions of the cutter can be selectively enabled and disabled independently of other portions of the plurality of portions of the cutter, the method of using the hand-held treating device performed in a controller of the treating device comprising:

receiving information on a predetermined pattern to be created on the part of the body to be treated by the treating device; and selectively enabling or disabling the treating action of each of the plurality of portions of the cutter according to the received information as the treating device is moved over the part of the body to create the predetermined pattern on the part of the body, wherein the treating device comprises a mechanism having a plurality of deflector elements, each one of the plurality of deflector elements corresponding to one of the plurality of portions of the cutter, and wherein disabling the treating action of the respective portion of the plurality of portions of the cutter comprises activating corresponding deflector elements and wherein enabling the treating action of the respective portion of the plurality of portions of the cutter comprises deactivating corresponding deflector elements while maintaining a given position of the plurality of portions of the cutter relative to the treating device when a deflector element of the plurality of deflector elements is activated and deactivated, and wherein when a respective deflector element is activated, the respective deflector element extends out in front of the corresponding one of the plurality of portions of the cutter and crossed a cutting plane of the cutter.

15. The method as claimed in claim 14, comprising directly connecting each deflector element of the plurality of deflector elements to a corresponding arm having a magnetic portion and a coil that surrounds the magnetic portion for correspondingly activating or deactivating each deflector element of the plurality of deflector elements.

16. The method as claimed in claim 15, comprising connecting each of the coils to control circuitry associated with the controller that controls a magnitude and direction of current supplied to each of the coils.

17. A computer program product comprising a computer readable medium having computer readable code embodied therein, the computer readable code being configured such that, on execution by a controller of a hand-held treating device that comprises a treating unit and the treating device being configured such that a treating action of each portion of a plurality of portions of the treating unit can be selectively enabled and disabled independently of the treating action of the other portions of the treating unit, wherein the controller is configured to perform the method of claim 14.

* * * * *